United States Patent [19]

O'Connor et al.

[11] Patent Number: 4,535,904

[45] Date of Patent: Aug. 20, 1985

[54] TOOL REMOVABLE TAMPER INDICATING CLOSURE

[75] Inventors: Michael C. O'Connor, South Windsor; George W. Hann, East Hartford, both of Conn.

[73] Assignee: Union Carbide Corporation, Danbury, Conn.

[21] Appl. No.: 680,571

[22] Filed: Dec. 11, 1984

[51] Int. Cl.[3] ..... B65D 55/02

[52] U.S. Cl. ..... 215/215; 215/224; 215/252; 215/258; 215/295; 220/284

[58] Field of Search ..... 215/215, 224, 250, 252, 215/253, 256, 258, 295; 220/284

[56] References Cited

U.S. PATENT DOCUMENTS

| | | | |
|---|---|---|---|
| 3,455,478 | 7/1969 | Fields et al. | 215/252 |
| 4,037,746 | 7/1977 | Ver Hage | 215/256 |
| 4,362,253 | 12/1982 | Wortley et al. | 220/276 |
| 4,385,711 | 5/1983 | Bowen | 215/215 |
| 4,461,390 | 7/1984 | Csaszar | 215/252 |
| 4,479,586 | 10/1984 | Csaszar | 215/258 |

*Primary Examiner*—George T. Hall

*Attorney, Agent, or Firm*—James L. Sonntag

[57] ABSTRACT

A tamper-indicating closure comprising a disc-shaped top with an upper skirt extending downwardly from the top; an annular upper bead around the inner surface of the upper skirt; a lower skirt proximate to and in center alignment with the upper skirt, the upper skirt being disposed between the top and the lower skirt; an annular retention bead around the inner surface of the lower skirt; a breakable bridge means between the skirts as the sole connection between the skirts; and a tool aperture between the skirts adapted to accept a tool means for breaking the bridge means so as to part the skirts.

39 Claims, 11 Drawing Figures

TOOL REMOVABLE TAMPER INDICATING CLOSURE

FIELD OF THE INVENTION

The instant invention relates to a closure for containers, such as bottles and the like, which is "tamper-indicating", that is indicating upon first opening of the container, whether or not the container has already been opened or tampered with. The invention also relates to "child-proof" closures which are difficult for a child to open, both on the first opening and on subsequent openings, but are easily opened by an adult.

BACKGROUND OF THE INVENTION

A known form of closure is the so-called "snap-on" closure which comprises a circular cap portion with a downwardly extending skirt. Upon the internal periphery of the skirt is an annular closure bead or series of beads that interlocks with a corresponding bead or groove on the neck of the container. The interlock provides an interference that resists removal of the cap from the container, and provides a seal between the container opening and the closure by firmly holding the closure upon the neck. The cap forms a tight seal upon the neck of the bottle, but is usually easily removed by an upward pressure on the cap periphery. The cap is easily reapplied again to the container by merely snapping it onto the neck with a downward pressure. The snap-on closure is often favored over so-called screw-on cap closures, because, unlike with a screw-on closure, the user of a snap-on closure needs only to provide the force to overcome resistance of the interlock and does not need to apply a force or torque to achieve the seal between the container neck opening and the closure. Therefore, a snap-on closure can provide a more reliable seal, especially when the closure is used by persons of varying strength and dexterity. Furthermore, the snap-on closure is less subject to misalignment which would prevent the seal, as might occur with a cross thread on a screw-on closure.

A problem with the simple snap-on closure is that it can be removed and reclosed without any indication that the container has been opened. It is, therefore, possible for someone to tamper with the contents of the container with no indication thereof to a subsequent user. Furthermore, although this closure is convenient and easy to use, some snap-on closures allow for a young child to open and gain access to the contents of the container. However, opening resistance may be increased and surface projections may be removed from snap-on closures to make it difficult for a child to open the container. In the packaging of certain substances, such as poisonous liquids, cleaning solutions, medicines, and the like, it is desirable to have such a closure resistant to opening by a child. It would be desirable, therefore, to have a closure which has the superior sealing characteristics, the ease of reopening for adults, and the ease of reclosure of the snap-on closure, and which also provides evidence of being opened after the first opening. It would also be desirable that such a closure be resistant to the efforts of the child to remove the closure on the first opening and subsequent reopenings.

A suggested solution to the problem of no tamper indication is disclosed in U.S. Pat. No. 4,037,746 to Ver Hage. Therein is disclosed a snap-on type closure with an extension of the downwardly extending skirt. On the inner surface of the skirt extension is a second annular retention bead that also fits into a corresponding groove on the neck of the container. The interlock of the retention bead and groove are such that the closure cannot be removed by an ordinary person without the retention bead being removed.

In order that the retention bead be detached from the closure so that the upper portion of the closure can be removed, a scored portion is provided between the two annular beads of the closure and a tab is provided on the lower extended portion of the skirt. The closure is opened by grasping the tab and tearing off the lower portion of the skirt along with the retention bead. The closure can then be removed and reclosed like a snap-on closure.

Another solution has been suggested by Wortley et al. in U.S. Pat. No. 4,362,253. This closure is similar to the Ver Hage closure in that it comprises a snap-on closure with a retention bead. Between the retention bead and the bead of the snap-on portion of the closure is a thin web or series of spaced webs. In this closure the retention bead is detached from the upper closure snap-on element by providing a lug on the upper portion. The user applies an upward pressure on the lug, which tears the web and allows the upper snap-on portion of the closure to be separated from the lower portion with the retention bead. The upper snap-on portion can then be reclosed and reopened like the snap-on closure.

While the Ver Hage and Wortley et al. closures provide a tamper-indicating closure, this benefit is accompanied by problems. One problem is that large graspable tabs or lugs are required for the first opening of the container in order to remove the lock bead. Since the closure is usually of a smooth plastic material, these tabs or lugs are often difficult to grasp, which causes difficulty in applying sufficient force to remove the lock bead portion. Thus, the opening of the container is often attended by frustration and painful fingers as the user tries to grasp the tab or push the lug to separate the retention bead portion.

This problem can be partially moderated by increasing the size of the tabs and/or lugs. However, as the size of the the tabs and/or lugs increases, there may be interference with the function of the closure as well as with access to the contents of the container.

Integral tabs or lugs also complicate the initial application of the closure to the container, which is usually done by automatic custom-designed applicators during the packaging operation. The production time, material requirements, and costs for producing the closure are also increased by the use of tabs and/or lugs. The increased material requirements lead not only to higher costs, but also to extra cooling time in the molding of the closure. Integral tabs and lugs also require the use of multi-piece molds, which increases costs and further complicates the molding operation.

Another problem with closures having integral tabs and lugs, is that they are generally not child-proof. In fact, lugs on the closure cap may actually assist the child in opening the container.

M. R. Fields, et al. disclose in U.S. Pat. No. 3,455,478 a general type of closure with a detachable retention ring similar to the above closures. The retention ring has an inner annular retention bead that prevents removal of the closure while the retention ring is attached to the closure. This closure does not have tabs or lugs to remove the retention ring, but uses screw/thread mechanism to separate the retention ring from an upper screw-on type cap when the closure is opened for the first time. As the closure cap is unscrewed, the frictional drag of the retention ring on a groove on the container neck, and the upward force caused by the screw mechanism, tear a frangible zone between the retention ring and the screw-on cap portion. The retention ring is thus removed from the closure. The screw-on cap portion of the closure is then unscrewed to open the container. A problem with this closure is that it is often difficult to apply sufficient torque to break the frangible zone. Weakening the frangible zone to ease removal partially solves this problem, but this also makes it easier for a child to also remove the cap, thus defeating any child-proof qualities of the closure. Also, after the first opening of the closure and the breaking of the frangible zone, there is no child-proof feature provided. Furthermore, this closure is of the screw-on type, and does not have the desirable sealing, reclosure, and reopening characteristics of a snap-on closure.

A common feature of the previously described prior art closures, is that the means for applying the force to open the closure for the first time to remove the retention bead, such as tabs, lugs, or the use of a thread/-screw, are incorporated into the closure element itself. This results in a compromise of the qualities of the closure, for example, with the Ver Hage and Wortley et al. closures, there is increased material requirements and, thus, increased costs. In the Fields et al. closure, the sealing and reopening/reclosing qualities of the snap-on closure are sacrificed by use of a screw-on type closure. Furthermore, as discussed above, none of these closures are completely satisfactory in providing an easy removal of the lock ring when the closure is opened for the first time, and none of these closures are child-proof to a satisfactory extent, neither upon the initial opening nor upon subsequent reopenings.

In view of these prior art closure problems, an object of the invention is to provide a snap-on type closure that has a tamper-indicating feature, but without additional material of construction. The first opening of the closure should require a minimum of strength, and yet be difficult for children to accomplish. Furthermore, after the closure is first opened, the closure should be reclosable and reopenable in the simple manner of the snap-on closure but provide resistance to the reopening by a child.

Other objects of the invention will become evident in the description that follows.

SUMMARY OF THE INVENTION

In its broadest aspect, the invention includes a tamper-indicating closure comprising a disc-shaped top with an upper skirt extending downwardly from the top; an annular upper locking bead around the inner surface of the upper skirt; a lower skirt proximate to and in center alignment with the upper skirt, the upper skirt being disposed between the top and and lower skirt; an annular retention bead around the inner surface of the lower skirt; a breakable bridge means between the upper skirt and the lower skirt as the sole connection between the upper and lower skirt; and a tool aperture between the upper and lower skirts adapted to accept a tool means for breaking the bridge means so as to part the upper and lower skirts.

Preferably the tamper-indicating closure of the invention comprises a disc-shaped top with a cylindrical upper skirt extending substantially perpendicularly and downwardly from the top, an annular upper locking bead around the inner surface of the upper skirt; a cylindrical lower skirt proximate and co-axial with the upper skirt, the upper skirt being disposed between the top and and lower skirt; an annular retention bead around the inner surface of the lower skirt; a breakable bridge means between the upper skirt and the lower skirt as the sole connection between the upper and lower skirt, and a tool aperture between the upper and lower skirts adapted to accept a tool means for breaking the bridge means so as to part the upper and lower skirts.

Preferably the closure of the invention also comprises a seal means to prevent leakage of liquids from the container. Preferably this seal means is provided by an inner annular skirt, concentric to and within the upper skirt, which extends downwardly from from the top.

Another aspect of the invention is an assembly comprising any of the above defined closures, and a container having a cooperating neck portion upon which the closure fits in center alignment, the neck portion having an upper interference surface that interlocks with the upper bead to provide a releasable interference to the removal of the closure when the upper and lower skirts are parted, and a retention interference surface below the upper interference surface that interlocks with the retention bead so as to prevent removal of the closure before the upper and lower skirts are parted.

The upper and lower retention interference surfaces may be provided by annular beads, annular grooves, or the like on the outer surface of the neck of the container. The annular beads may be continuous or be intermittant to form annularly spaced projections around the neck portion.

The closure of the present invention provides a tamper-indicating, snap-on type closure, that is easy for an adult to open the first time and can be easily reclosed and reopened by an adult. The closure comprises a lower skirt removably attached to an upper snap-on closure assembly by a breakable bridge means and is provided with a tool aperture between the upper snap-on assembly and the lower skirt. The closure is opened by inserting a flat broad tool such as a coin or screw driver in the tool aperture and breaking the bridge by prying and/or twisting the tool. This parts the lower skirt with the retention bead from the upper snap-on assembly, allowing removal of the top snap-on assembly of the closure from the neck of the container. The removable snap-on assembly portion of the closure, with the lower skirt removed, is similar to the conventional snap-on closure and can be reclosed and reopened in the same manner. The lower skirt remains firmly locked around the neck of the container, providing a clear indication that the container has been opened.

An advantage of the closure system of the invention over the prior art closures is that the first opening of the closure is accomplished by use of a tool separate from the closure. This allows the user to apply a much greater force to remove the lower skirt with the retention bead than is possible using the prior-art tabs, lugs, and thread/screw assemblies incorporated into the closure. A wide variety of tools, from coins to large screw drivers, can be used. Thus, the user can choose a tool adapted to his own strength and dexterity. Furthermore, it is unlikely that a young child, even if it has access to a tool, has the dexterity and knowledge to insert the tool into the aperture and apply the appropriate twisting and/or prying action to part the upper and lower skirts so as to remove the closure top. Resistance to subsequent openings of the closure by a child can be achieved by increasing the releasable interference between the upper bead and upper interference surface, such that a tool and/or the strength of an adult are required to reopen the closure.

It is known to use tools to remove simple snap-on type closures not having a tamper-indicating feature by merely prying the closure up. Some of these closures are used with a foil face-liner that provides a tamper-indication when the closure is removed. However, the applicants are not aware of any teaching in the art that would imply a tool-removable, tamper-indicating feature as in the present invention, wherein a lower skirt having a retention bead is parted from the upper snap-on portion with a tool to provide tamper-indication.

Since no added lugs or tabs are required with the closure of the invention, there are no additional material needs. The fabrication of the tool apertures to receive the tool actually reduces the material requirements and, thus, the costs of the closure manufacture. The absence of lugs and the like also increases the difficulty for a child to open the closure, both by the first opening and subsequent reopenings, thus, allowing the closure of the invention to be child-proof.

Since the closures of the invention are of the snap-on type, they also have the effective sealing properties of this class of closures. The sealing properties of the closure of the invention may be optionally improved, by an inner skirt extending downwardly from the top, providing a seal between the closure and the container neck.

BRIEF DESCRIPTION OF THE DRAWINGS

The invention will now be further described with reference to the following drawings.

DETAILED DESCRIPTION OF THE INVENTION

Figure 1A:
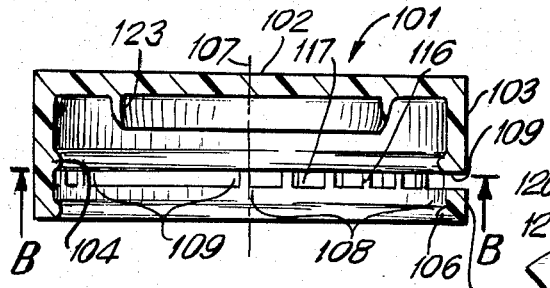
FIG. 1*a* is a cross-sectional view from the side of a closure of the invention taken through the cylindrical axis of the closure.

The invention is illustrated in the following figures, with the same numbers referring to corresponding parts in the various views.

Referring to FIGS. 1*a*, 1*b*, 1*c*, 1*e*, 2*a*, 2*b*, and 2*d*, closure 101 comprises a disc-like top 102 with an upper skirt 103 extending downwardly from the top 102. The top 102 is preferably circular as shown, although it may be any other disc-like shape, with the edges of the disc extending over the upper skirt 103. The upper skirt 103 is preferably in the form of a cylinder extending substantially perpendicular to the plane of the top 102.

An upper annular locking bead 104 is located upon the inner surface of the upper skirt 103. There may be more than one upper bead, but preferably there is only one upper bead 104, as shown.

A lower skirt 105 is proximate to and in center alignment with the upper skirt 103, that is with the center axis 107 of the lower skirt 105 corresponding with the center axis 107 of the upper skirt 103. The lower skirt is preferably in the form of a cylinder and is co-axial, having a common cylindrical center axis 107, with the upper skirt 103. The upper and lower skirts 103, 105 are such that, the upper skirt 103 is disposed between the top 102 and the lower skirt 105. At least one annular retention bead 106 is positioned upon the inner surface of the lower skirt 105. Between the lower skirt 105 and the upper skirt 103 is at least one breakable bridge means 108 as the sole means connecting the upper skirt 103 and lower skirt 105, and at least one tool aperture 109 adapted to accept a tool means 110 (shown in FIG. 1*b*, 1*c*, and 2*b*). The tool means 110 is preferably a coin (such as an American quarter which is about 25 mm in diameter).

Preferably, as illustrated in the figures, the closure of the invention has the upper bead 104 at the bottom of the inner surface of the upper skirt 103 in a direction away from the top 102, and the retention bead 106 is at the bottom of the inner surface of the lower skirt 105.

Figure 1B:
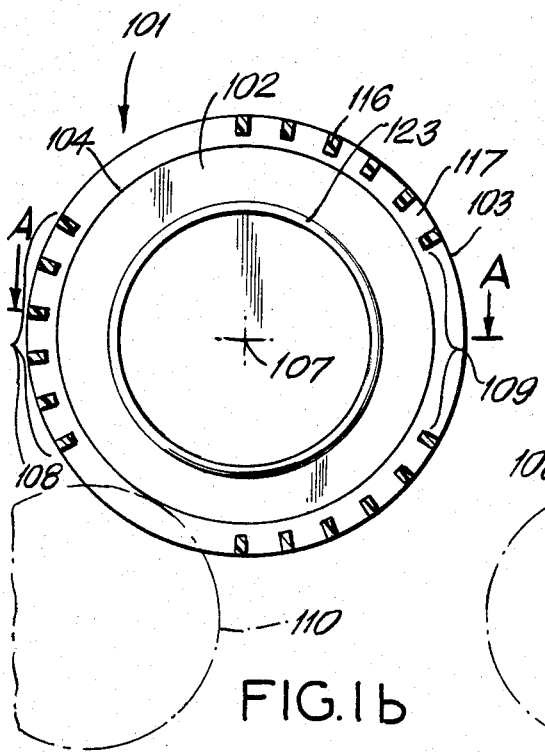
FIG. 1*b* is a bottom cross-sectional view of the closure of FIG. 1*a* taken through line B—B of FIG. 1*a*. The plane of sectioning of FIG. 1*a* is indicated by A—A in FIG. 1*b*.
Figure 2A:
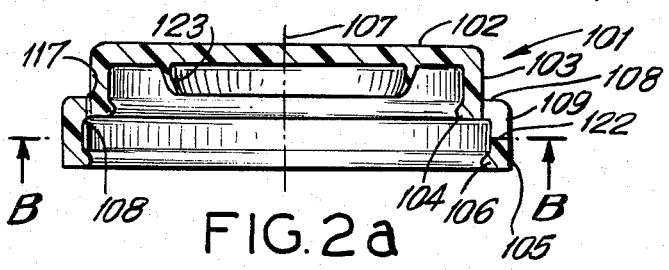
FIG. 2*a* is a cross-sectional view from the side of a closure of the invention through the cylindrical axis of the closure. This closure has a lower skirt portion with a larger diameter than the upper skirt portion.

Between the upper and lower skirts 103, 105, there is at least one breakable bridge means 108, and at least one tool aperture 109. The bridge means may comprise a plurality of bridges 116 separated by a series of secondary apertures 117 in circumferential alignment, as shown in FIG. 1*a*, 1*b*, 2*a*, 2*b* and 2*d*. The secondary apertures 117 may be sized larger than the bridges 116, as illustrated in FIGS. 1*a*, and 1*b* or the secondary apertures 117 may be shorter and formed as cylindrical holes in the bridge means 108, as illustrated in FIGS. 2*a*, 2*b*, and 2*d*.

The bridge means 108 may also merely comprise an extension of the walls of the upper and lower skirts 103, 105, preferably of less thickness than the walls of the upper and/or lower skirts 103, 105. This alternate embodiment is illustrated in FIG. 1*c*. Also as shown in FIG. 1*c*, the wall of the bridge means 108 may have corrugations oriented in the direction of the cylindrical center axis 107 of the closure 101.

Figure 1D:
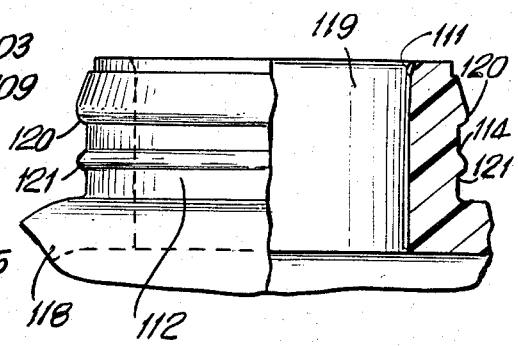
FIG. 1*d* is a side view of the neck of a container suitable for use with the closure of FIG. 1*a*, with a cutout showing the cross-section of the neck through the vertical axis of the container.
Figure 1C:
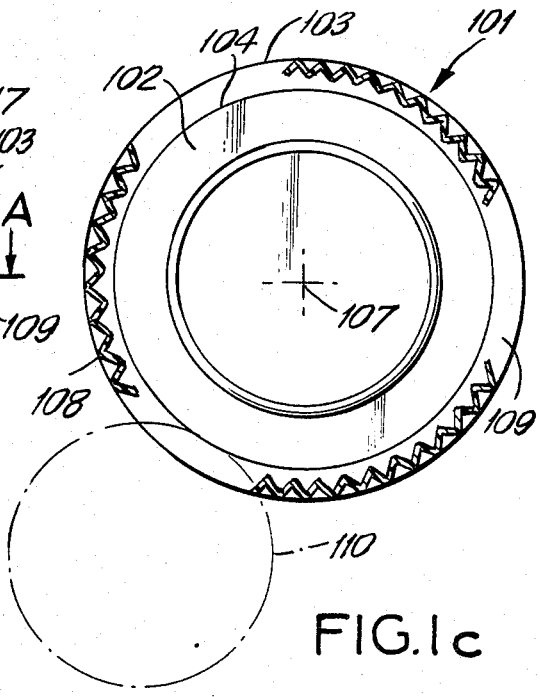
FIG. 1*c* is a bottom cross-sectional view of a closure as in FIG. 1*b*, but with an alternate form of the breakable bridge between the upper and lower skirt.
Figure 2C:
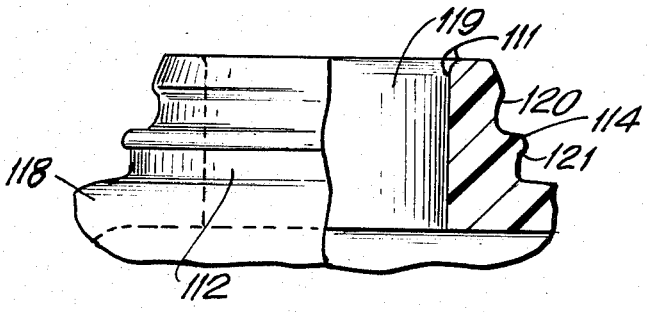
FIG. 2*c* is a side view of the neck of a container suitable for use with the closure of FIG. 2*a*, with a cutout showing the cross-section of the neck through the vertical axis of the container.
Figure 2B:
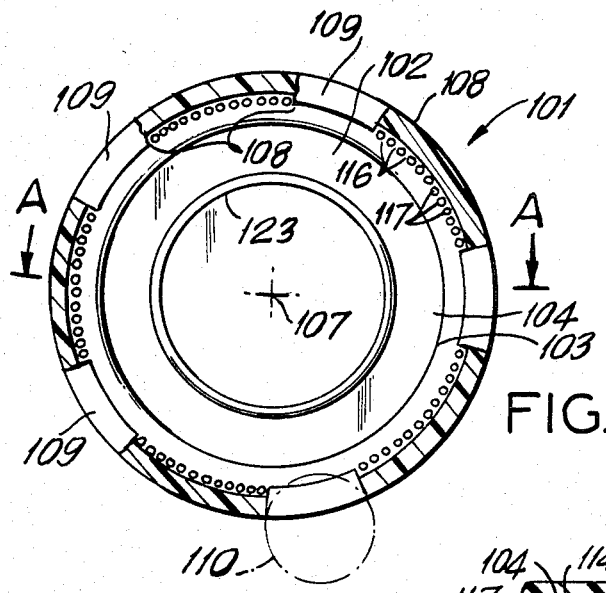
FIG. 2*b* is a bottom cross-sectional view of the closure of FIG. 1*a* taken through line B—B of FIG. 1*a*. The plane of sectioning of FIG. 2*a* is indicted by A—A in FIG. 2*b*.
Figure 2D:
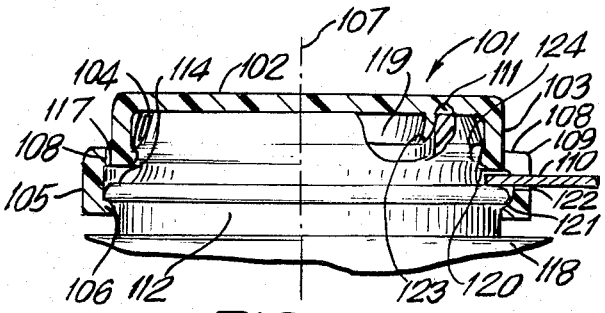
FIG. 2*d* is a side cross-sectional view of an assembly the invention showing the closure of FIG. 2*a* and 2*b* applied to the neck of FIG. 2*c*.

FIG. 1*d* and 2*c*, show necks 112 of containers 118 upon which the closures 101 of FIGS. 1*a*, and 2*a*, respectively, fit. The container 118 is typically a bottle of any suitable material, such as glass, or plastic, such as polyethylene, polypropylene, polystyrene, polyvinyl chloride, or polycarbonate. As shown by these figures, the container neck 112 terminates in an opening 119 and it has at least one upper interference surface 120, and at least one retention interference surface 121 below the upper interference surface 120. Preferably the number of each of the interference surfaces 120, 121 is one, as illustrated. The interference surfaces may be provided by beads, grooves, and the like, on the outer surface of the container neck 112. Preferably, the interference surfaces 120, 121 are provided by beads, as illustrated. The beads may be intermittant to provide annularly spaced projections.

Figure 1E:
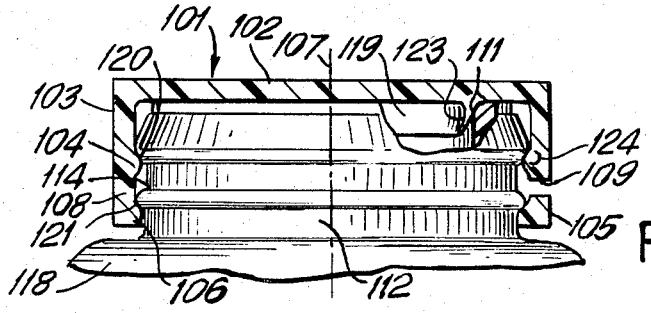
FIG. 1*e* is a side cross-sectional view of an assembly of the invention showing the closure of FIG. 1*a* and 1*b* applied to the neck of FIG. 1*d*.

As shown in FIGS. 1*e* and 2*d*, when the closure is applied to the container neck 112, the retention bead 106 of the closure 101 interlocks with the retention interference surface 121, so as to permanently prevent the removal of the lower skirt 105. In order to open the container 118 for the first time, the bridge means 108 must be broken. After the first opening, there is a clear indication to the user that the container 118 has been opened by the presence of the lower skirt 105 remaining upon the bottle neck, and also by the remnant of the broken bridge means 108 upon the upper and lower skirts 103, 105.

Upper bead 104 interlocks with the upper interference surface 120, to provide a releasable interference to the removal of the upper skirt 103 from the container neck 112. After the first opening, when the the upper skirt 103 and the lower skirt 105 have been parted, the upper snap-on assembly portion of the closure 101 comprising the top 102, upper skirt 103 and upper bead 104, provide a closure similar to the conventional snap-on closure and may be reclosed and reopened in the same manner as that type of closure.

Preferably there is a plurality of equally sized bridge means 108, separated by the same number of equally sized tool apertures 109, although plural bridge means 108 and/or tool apertures 109 may have unequal circumferential lengths. This provides easy access to the tool aperture 109, regardless of the orientation of the closure upon the neck 112 of the container 118. The tool apertures 109 may be sized larger or shorter than the bridge means 108 in the circumferential direction. The tool aperture is preferably sized to receive a coin, such as an American quarter (dia. about 25 mm).

A first fulcrum surface 114 may also be provided on the neck 112 to assist in removal of the upper skirt 103 from the neck 112 of the container 118. As illustrated, the first fulcrum surface 114 may be provided by the upper surface of the bead that forms the retention interference surface 121. During the first opening, the end of the tool means 110 is inserted in the tool aperture 109. After setting the end of the tool means 110 on the first fulcrum surface 114, the tool means 110 is twisted or pried, using the first fulcrum surface 114 as a fulcrum point, to part the upper and lower skirts 103, 105, and remove the upper skirt from the neck 112. After the first opening, when the upper and lower skirts 103, 105 are parted, the closure may be reclosed by forcing the top 102, upper skirt 103, upper bead 104 assembly over the neck 112 in the manner of a conventional snap-on closure. In reopening the closure 101, the first fulcrum surface 114 can be used again as a fulcrum point to reopen the container. This makes practical a greater releasable interference between the upper bead 104 and the upper interference surface 120, to provide a greater resistance to opening. Thus, the closure can be rendered child-proof, since children would typically have insufficient strength and lack the dexterity to reopen the closure 101, either by hand or with a tool means 110.

FIGS. 2*a*, 2*b*, 2*c*, and 2*d* show a preferred embodiment of the closure of the invention, wherein the diameter of the lower skirt 105 is greater than the diameter of the upper skirt 103. An advantage with this embodiment is that the lower skirt 105 provides a second fulcrum surface 122 upon the lower boundry of the tool aperture 109 for a tool means 110, which enables the user to apply a greater prying and/or twisting force to separate the upper and lower skirts 103, 105, during the first opening of the closure. Another advantage of this embodiment, is that the closure 101 can be originally applied to the container neck 112 during packaging without prestressing the retention bead 106 as it passes over the upper interference surface 120 on the bottle neck 112. This contrasts with closures as in FIGS. 1*a* to 1*e*, wherein the retention bead 106, must pass over both the upper interference surface 120 and the retention interference surface 121 during the first application, thereby subjecting the bridge means 108, to undue stress and possible failure.

After the first opening, the lower skirt 105 remains upon the container neck 112, which provides a clear indication to a subsequent user that the container 118 has been opened. Opening of the container 118 is also indicated by the broken remnants of the bridge means 108 that remain on the upper and lower skirts 103, 105. The required use of a tool means 110 for the first opening provides a child-proof feature. A child-proof feature can also be provided for subsequent reopenings, as explained above, by providing a first fulcrum surface 114, and providing sufficient interference to removal of the upper skirt 103 by the interlock of the upper bead and interference surface 104, 120, so as to require use of a tool means 110 to again remove the closure 101.

Preferably there is a seal means between the closure 101, and the container neck 112 to prevent fluids from leaking out of the container 118, when the closure is in place. The seal means is preferably a primary seal surface 111 on the container neck 112, wherein a seal is provided between the primary seal surface 111 and an inner skirt 123, which extends downwardly, preferably substantially perpendicularly, from the top 102, with a common center axis 107 to the upper skirt 103. The inner skirt 123 may be substantially cylindrical or be slightly frustoconical, with the diameter in the direction away from the top 102 becoming slightly smaller.

In addition to the primary seal surface 111, a secondary seal surface 124 may also be provided at upper interferrence surface 120, wherein a seal is provided by the interlock of the upper bead and interference surface 104, 120.

Other known seal means used for snap-on type closures may also be provided. For example the inner skirt 123 may be replaced with inserts of cork, cardboard, elastomeric material, or the like, on the underside surface of the top 102.

Figure 3:
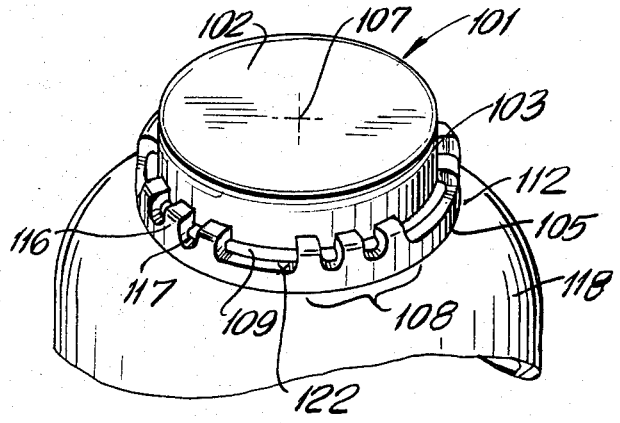
FIG. 3 is a perspective view from above of an assembly of a closure of the invention applied to the top of a container.

In FIG. 3, is shown a perspective view of a closure/-neck assembly similar to the assembly of FIG. 2*d*, illustrating how the top of the container would appear to a user before the first opening of the container.

Figure 4:
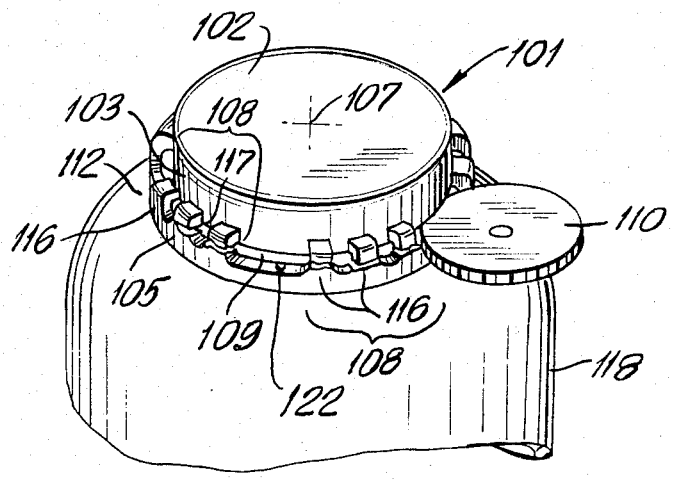
FIG. 4 is a perspective view of the assembly of FIG. 3 showing the closure in the process of being removed to open the container.

In FIG. 4 is shown the assembly of FIG. 3 with the lower 105 skirt partially parted when closure 101 is being opened for the first time. A tool means 110, such as a screwdriver blade or, preferably, a coin such as an American quarter (dia. about 25 mm), is inserted in a tool aperture 109 and twisted and pried so as to break the bridge means 108 and part the upper and lower skirts 103, 105. In FIG. 4 is illustrated partial breakage of the bridges means 108 and a partial parting of the upper and lower skirts 103, 105.

The closures of the invention are sized according the intended use and to conventional practice in the art. As a specific example, a closure as illustrated in FIGS. 1*a*, 1*b*, 1*c*, and 1*e* would typically be about 4 cm in diameter and about 1.4 cm in height for a liquid container having a neck opening of about 2.5 cm. Similarly, a closure as illustrated in FIGS. 2*a*, 2*b*, 2*c*, and 2*e* would be about 4.6 cm in diameter over the lower skirt and about 1.3 cm in height for a liquid container with a neck opening of about 2.5 cm.

The closures of the invention are made of a resilient material, preferably thermoplastic polymer such as polyethylene, polypropylene, polystyrene, polycarbonate, polyvinyl chloride, or the like. They may be made by any suitable method, an injection molding method being preferred.

Although the invention has been described by reference to specific examples and to the figures, it is understood that variations and alterations are within the spirit of the invention and they are contemplated as being included within the scope the claims.

What is claimed is:

1. A tamper-indicating closure comprising a disc-shaped top with an upper skirt extending downwardly from the top; an annular upper locking bead around the inner surface of the upper skirt; a lower skirt proximate to and in center alignment with the upper skirt, the upper skirt being disposed between the top and the lower skirt; an annular retention bead around the inner surface of the lower skirt; breakable bridge means between the upper skirt and the lower skirt as the sole connection between the upper and lower skirt; and a tool aperture between the upper skirt and the lower skirt adapted to accept a tool means for breaking the bridge means so as to part the upper and lower skirts.

2. A tamper-indicating closure comprising a disc-shaped top with a cylindrical upper skirt extending downwardly from the top; an annular upper locking bead around the inner surface of the upper skirt; a cylindrical lower skirt proximate and co-axial with the upper skirt, the upper skirt being disposed between the top and and lower skirt; an annular retention bead around the inner surface of the lower skirt; breakable bridge means between the upper skirt and the lower skirt as the sole connection between the upper and lower skirt; and a tool aperture between the upper skirt and the lower skirt adapted to accept a tool means for breaking the bridge means so as to part the upper and lower skirts.

3. The closure of claim 1 or 2 wherein the upper skirt extends substantially perpendicularly from the top.

4. The closure of claim 1 or 2 additionally comprising an inner annular skirt concentric to the upper skirt and extending downwardly from the top.

5. The closure of claim 1 or 2 wherein there is one upper locking bead and one retention bead.

6. The closure of claim 5 wherein the upper locking bead is near the bottom periphery of the upper skirt and the retention bead is near the bottom periphery of the lower skirt.

7. The closure of claim 2 wherein the breakable bridge means comprises a plurality of bridges on the closure circumference, with adjacent bridges circumferentially separated by a series of secondary apertures.

8. The closure of claim 7, wherein the secondary apertures are longer than the bridges in the circumferential direction.

9. The closure of claim 7, wherein the secondary apertures are shorter than the bridges in the circumferential direction.

10. The closure of claim 1 or 2 wherein the bridge means has a continuous surface and the wall thickness of the bridge means is less than the wall thickness of the upper or lower skirts.

11. The closure of claim 10 wherein the bridge means is corrugated.

12. The closure of claim 2 wherein there are a plurality of bridge means with adjacent bridge means circumferentially separated by tool apertures.

13. The closure of claim 12 wherein the tool apertures are of equal size.

14. The closure of claim 12 wherein the bridge means are of equal size.

15. The closure of claim 12 wherein the tool apertures are sized longer than the bridge means in the circumferential direction.

16. The closure of claim 12 wherein the tool apertures are sized shorter than the bridge means in the circumferential direction.

17. The closure of claim 13 wherein the tool apertures are sized to receive a disc-shaped tool about 25 mm in diameter.

18. The closure of claim 2 wherein the lower skirt has a larger diameter than the upper skirt.

19. An assembly comprising (A) a closure which comprises a disc-shaped top with an upper skirt extending downwardly from the top; an annular upper locking bead around the inner surface of the upper skirt; a lower skirt proximate to and in center alignment with the upper skirt, the upper skirt being disposed between the top and lower skirt; an annular retention bead around the inner surface of the lower skirt; breakable bridge means between the upper skirt and the lower skirt as the sole connection between the upper and lower skirt; and a tool aperture between the upper skirt and the lower skirt adapted to accept a tool means for breaking the bridge means so as to part the upper and lower skirts, and (B) a container having a cooperating neck portion upon which the closure fits in center alignment, the neck portion having an upper interference surface that interlocks with the upper locking bead to provide a releasable interference to the removal of the closure when the upper and lower skirts are parted, and having a retention interference surface below the upper interference surface that interlocks with the retention bead so as to prevent removal of the closure before the upper and lower skirts are parted.

20. An assembly comprising (A) a closure which comprises a disc-shaped top with a cylindrical upper skirt extending downwardly from the top; an annular upper locking bead around the inner surface of the upper skirt, a cylindrical lower skirt proximate and co-axial with the upper skirt; the upper skirt being disposed between the top and and lower skirt, an annular retention bead around the inner surface of the lower skirt; breakable bridge means between the upper skirt and the lower skirt as the sole connection between the upper and lower skirt, and a tool aperture between the upper skirt and the lower skirt, adapted to accept a tool means for breaking the bridge means so as to part the upper and lower skirts, (B) a container having a cooperating cylindrical neck portion upon which the closure fits in co-axial alignment, the neck portion having an upper interference surface that interlocks with the upper locking bead to provide a releasable interference to the removal of the closure when the upper and lower skirts are parted, and having a retention interference surface below the upper interference surface that interlocks with the retention bead so as to prevent removal of the closure before the upper and lower skirts are parted.

21. The assembly of claim 20 wherein the upper skirt extends substantially perpendicularly from the top.

22. The assembly of claim 19 or 20 wherein the upper interference surface is provided by a bead around the outer surface of the neck of the container.

23. The assembly of claim 19 or 20 wherein the retention interference surface is provided by a bead around the outer surface of the neck of the container.

24. The assembly of claim 20 wherein the diameter of the neck portion at the retention interference surface is greater than the diameter of the neck portion at the upper interference surface.

25. The assembly of claim 20 which additionally comprises an inner annular skirt concentric to the upper skirt and extending downwardly from the top.

26. The assembly of claim 19 or 20 wherein there is one upper locking bead and one retention bead.

27. The assembly of claim 19 or 20 wherein the upper locking bead is near the bottom periphery of the upper skirt and the retention bead is near the bottom periphery of the lower skirt.

28. The assembly of claim 20 wherein the bridge means comprises a plurality of bridges on the closure circumference, with adjacent bridges circumferentially separated by a series of secondary apertures.

29. The assembly of claim 28, wherein the secondary apertures are longer than the bridges in the circumferential direction.

30. The assembly of claim 28, wherein the secondary apertures are shorter than the bridges in the circumferential direction.

31. The assembly of claim 28 wherein the bridge means has a continuous surface and the wall thickness of the bridge means is less than the wall thickness of the upper or lower skirts.

32. The assembly of claim 31 wherein the bridge means is corrugated.

33. The assembly of claim 20 wherein there are a plurality of bridge means with adjacent bridge means circumferentially separated by tool apertures.

34. The assembly of claim 33 wherein the bridge means are of equal size.

35. The assembly of claim 33 wherein the tool apertures are of equal size.

36. The assembly of claim 33 wherein the tool apertures are sized longer than the bridge means in the circumferential direction.

37. The assembly of claim 33 wherein the tool apertures are sized shorter than the bridge means in the circumferential direction.

38. The assembly of claim 33 wherein the tool apertures are sized to receive a disc-shaped tool about 25 mm in diameter.

39. The assembly of claim 20 wherein the lower skirt has a larger diameter than the upper skirt.

* * * * *